US011004383B2

(12) United States Patent
Jang et al.

(10) Patent No.: US 11,004,383 B2
(45) Date of Patent: May 11, 2021

(54) LIGHT EMITTING DISPLAY APPARATUS INCLUDING A PLURALITY OF PIXELS AND METHOD FOR DRIVING THEREOF

(71) Applicant: LG Display Co., Ltd., Seoul (KR)

(72) Inventors: Yongho Jang, Paju-si (KR); Kwangll Chun, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 70 days.

(21) Appl. No.: 16/210,587

(22) Filed: Dec. 5, 2018

(65) Prior Publication Data

US 2019/0180675 A1 Jun. 13, 2019

(30) Foreign Application Priority Data

Dec. 7, 2017 (KR) ..... 10-2017-0167192

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/043* (2013.01); *G09G 2300/0452* (2013.01); *G09G 2300/0819* (2013.01); *G09G 2300/0861* (2013.01); *G09G 2310/0251* (2013.01); *G09G 2310/0262* (2013.01); *G09G 2310/0289* (2013.01); *G09G 2310/08* (2013.01); *G09G 2330/028* (2013.01)

(58) Field of Classification Search
CPC .. G09G 3/32; G09G 3/3233; G09G 2300/043; G09G 2300/0452
USPC ..... 345/82
See application file for complete search history.

(56) References Cited

U.S. PATENT DOCUMENTS

2008/0143264 A1* 6/2008 Minami ..... G09G 3/3233 315/169.3
2008/0291182 A1* 11/2008 Yamashita ..... G09G 3/3233 345/204
2009/0219234 A1* 9/2009 Yamamoto ..... G09G 3/3233 345/80
2010/0289793 A1* 11/2010 Yamamoto ..... G09G 3/3233 345/213
2017/0221422 A1 8/2017 Hwang et al.

FOREIGN PATENT DOCUMENTS

KR 10-2017-0092746 A 8/2017

* cited by examiner

*Primary Examiner* — Jonathan M Blancha
(74) *Attorney, Agent, or Firm* — Morgan, Lewis & Bockius LLP

(57) ABSTRACT

A light emitting display apparatus includes a light emitting display panel including a plurality of pixels each operating in order of an initialization period, a sampling period, an offset voltage formation period, a data writing period, and a light emission period; a data driving circuit configured to supply data voltage to each of the pixels; a gate driving circuit configured to provide, to each of the pixels, a control signal having voltage levels determined for the initialization period, the sampling period, the offset voltage formation period, the data writing period, and the light emission period of a corresponding pixel; and a timing controller configured to control the data driving circuit and the gate driving circuit, wherein the offset voltage formation period is longer than the sampling period.

18 Claims, 4 Drawing Sheets

LIGHT EMITTING DISPLAY APPARATUS INCLUDING A PLURALITY OF PIXELS AND METHOD FOR DRIVING THEREOF

This application claims the benefit of the Korean Patent Application No. 10-2017-0167192 filed on Dec. 7, 2017, which is hereby incorporated by reference.

BACKGROUND

Technical Field

The present disclosure relates to a light emitting display apparatus and a driving method thereof.

Discussion of the Related Art

In the field of display apparatuses, liquid crystal display (LCD) apparatuses, which are light and are low in power consumption, are being widely used, but need a separate light source such as a backlight. In contrast, light emitting display apparatuses may display an image by using a self-emitting device. In comparison with the LCD apparatuses, the light emitting display apparatuses have a fast response time, low power consumption, and a good viewing angle, and thus, are attracting much attention as next-generation display apparatuses.

A general light emitting display apparatus includes a pixel circuit formed for each pixel. The pixel circuit displays a predetermined image by switching a driving transistor according to a data voltage to control the magnitude of current flowing from a driving power source to a light emitting device, thereby causing the light emitting device to emit light.

In a general light emitting display apparatus, a current flowing through a light emitting device of each pixel may change due to variations in threshold voltage of a driving transistor caused by a process variation. Accordingly, a pixel circuit of a general light emitting display apparatus may include an internal compensation circuit for compensating for a threshold voltage of a driving transistor, because a data current output from the driving transistor is different for each pixel even if the same data voltage is applied. Uniform image quality may be difficult to achieve.

In the related art, a pixel circuit having an internal compensation circuit samples a threshold voltage of a driving transistor during a sampling period, stores the sampling voltage in a capacitor, and compensates for the threshold voltage of the driving transistor using the sampling voltage stored in the capacitor.

However, there may be a difference between a sampling voltage and an actual threshold voltage of a driving transistor. Also, a sampling variation may occur between sampling voltages stored in capacitors of pixels due to a threshold voltage variation between driving transistors provided in the pixels. As a result, image quality may be deteriorated due to the voltage variation between the pixels caused by the sampling voltage variation.

SUMMARY

Accordingly, the present disclosure is directed to a light emitting display apparatus and method for driving thereof that substantially obviates one or more of the problems due to limitations and disadvantages of the related art.

An object of the present disclosure is to provide a light emitting display apparatus for preventing a deterioration in image quality due to a voltage variation between pixels caused by a threshold voltage variation between driving transistors provided in the pixels, and a driving method thereof.

Additional features and advantages of the disclosure will be set forth in the description which follows, and in part will be apparent from the description, or may be learned by practice of the disclosure. The objectives and other advantages of the disclosure will be realized and attained by the structure particularly pointed out in the written description and claims hereof as well as the appended drawings.

To achieve these and other advantages and in accordance with the purpose of the disclosure, as embodied and broadly described, the light emitting display apparatus may include a light emitting display panel including a plurality of pixels each operating in order of an initialization period, a sampling period, an offset voltage formation period, a data writing period, and a light emission period; a data driving circuit configured to supply data voltage to each of the pixels; a gate driving circuit configured to provide, to each of the pixels, a control signal having voltage levels determined for the initialization period, the sampling period, the offset voltage formation period, the data writing period, and the light emission period of a corresponding pixel; and a timing controller configured to control the data driving circuit and the gate driving circuit, wherein the offset voltage formation period is longer than the sampling period.

In another aspect, the method of driving a light emitting display apparatus including a plurality of pixels each having a light emitting device and a pixel circuit connected to the light emitting device, may include operating each of the pixels in order of an initialization period, a sampling period, an offset voltage formation period, a data writing period, and a light emission period, wherein the offset voltage formation period is longer than the sampling period.

It is to be understood that both the foregoing general description and the following detailed description of the present disclosure are explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate example embodiments of the disclosure and together with the description serve to explain the principles of the disclosure. In the drawings.

DETAILED DESCRIPTION

Figure 1:
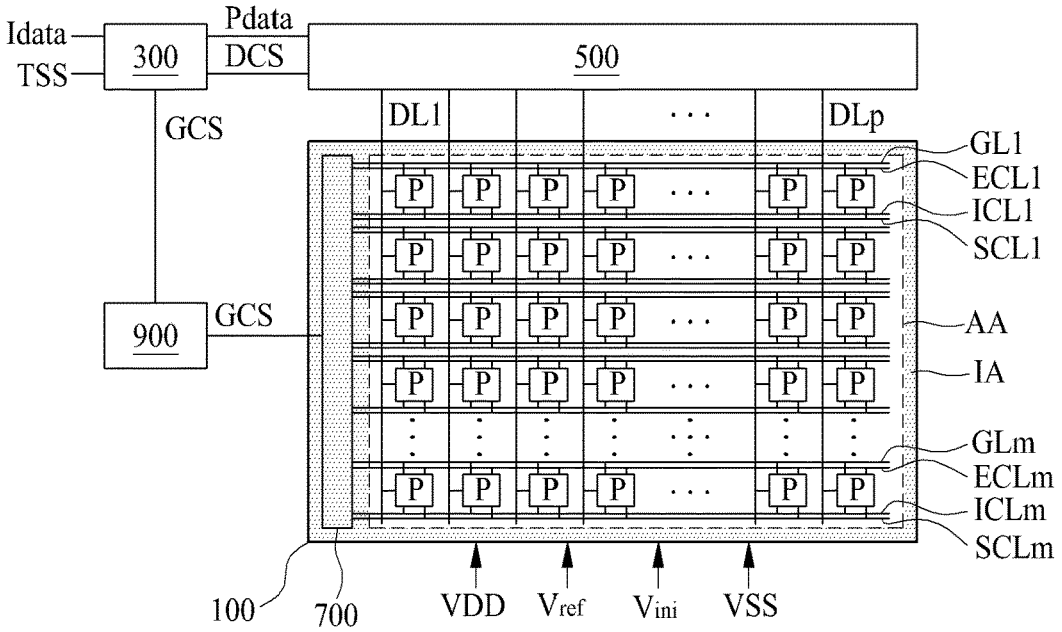
FIG. 1 is a view schematic showing a light emitting display apparatus according to an example embodiment of the present disclosure.

Reference will now be made in detail to the example embodiments of the present disclosure, examples of which are illustrated in the accompanying drawings.

It will be apparent to those skilled in the art that various modifications and variations can be made in the light emitting display apparatus and method for driving thereof of the present disclosure without departing from the spirit or scope of the disclosure. Thus, it is intended that the present disclosure cover the modifications and variations of this disclosure provided they come within the scope of the appended claims and their equivalents.

A shape, a size, a ratio, an angle, and a number disclosed in the drawings for describing example embodiments of the present disclosure are merely an example, and thus, the present disclosure is not limited to the illustrated details. Like reference numerals refer to like elements throughout. In the following description, when the detailed description of the relevant known technology is determined to unnecessarily obscure the important point of the present disclosure, the detailed description will be omitted.

In a case where "comprise," "have," and "include" described in the present specification are used, another part may be added unless "only" is used. The terms of a singular form may include plural forms unless referred to the contrary.

In construing an element, the element is construed as including an error range although there is no explicit description.

In describing a position relationship, for example, when a position relation between two parts is described as "on," "over," "under," and "next," one or more other parts may be disposed between the two parts unless "just" or "direct" is used.

In describing a time relationship, for example, when the temporal order is described as "after," "subsequent," "next," and "before," a case which is not continuous may be included unless "just" or "direct" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various example embodiments of the present disclosure may be partially or overall coupled to or combined with each other, and may be variously inter-operated with each other and driven technically as those skilled in the art can sufficiently understand. The example embodiments of the present disclosure may be carried out independently from each other, or may be carried out together in co-dependent relationship.

Hereinafter, a light emitting display apparatus and a driving method thereof according to example embodiments of the present disclosure will be described in detail with reference to the accompanying drawings. In adding reference numerals to elements of each of the drawings, although the same elements are illustrated in other drawings, like reference numerals may refer to like elements. In the following description, when the detailed description of the relevant known function or configuration is determined to unnecessarily obscure the important point of the present disclosure, the detailed description will be omitted.

FIG. 1 is a view schematic showing a light emitting display apparatus according to an example embodiment of the present disclosure.

With reference to FIG. 1, the light emitting display apparatus according to an example embodiment of the present disclosure includes a light emitting display panel 100, a timing control unit 300, a data driving circuit 500, and a gate driving circuit (or a gate driver) 700.

The light emitting display panel 100 may include a display area AA (e.g., active area) defined on a substrate and a non-display area IA (e.g., inactive area) surrounding the display area AA.

The display area AA may include a plurality of pixels P respectively provided in a plurality of pixel areas which are defined by first to $m^{th}$ (where m is a natural number equal to or more than two) gate lines GL1 to GLm, first to $m^{th}$ emission control lines ECL1 to ECLm, and a plurality of data lines DL1 to DLp (where p is a natural number equal to or more than two). Also, the display area AA may further include first to $m^{th}$ initialization control lines ICL1 to ICLm and first to $m^{th}$ sampling control lines SCL1 to SCLm. Furthermore, the display area AA may further include a plurality of pixel driving voltage lines supplied with a pixel driving voltage VDD, a plurality of initialization voltage lines supplied with an initialization voltage Vini, a plurality of reference voltage lines supplied with a reference voltage Vref, and a cathode electrode layer CEL (see FIG. 2) supplied with a cathode voltage VSS.

The pixels P according to an example embodiment may be provided in a stripe structure. In this case, each of the pixels P may include a red subpixel, a green subpixel, and a blue subpixel, and may further include a white subpixel.

However, example embodiments are not limited thereto, and according to another example embodiment, the plurality of pixels P may be arranged in a pentile structure in the display area AA. In this case, each of the plurality of pixels P may include one red subpixel, two green subpixels, and one blue subpixel, which are one-dimensionally arranged as a polygonal type. For example, each of the pixels P having the pentile structure may include one red subpixel, two green subpixels, and one blue subpixel, which are one-dimensionally arranged as an octagonal type. In this case, the blue subpixel may have a largest size, and each of the two green subpixels may have a smallest size.

Each of a plurality of pixels P arranged in a lengthwise direction of a gate line GL may be connected to the gate line GL, an emission control line ECL, an initialization control line ICL, a sampling control line SCL, a data line DL, a pixel driving voltage line, an initialization voltage line, a reference voltage line, a cathode electrode layer CEL, which pass through a corresponding pixel area. One pixel driving voltage line, one initialization voltage line, and one reference voltage line may be connected to one subpixel or one unit pixel.

The plurality of pixels P operate in the order (e.g., signal) of an initialization period, a sampling period, an offset voltage formation period, a data writing period, and a light emission period, and emit light by a data current corresponding to a data voltage supplied to the data line DL. Here, the offset voltage formation period may be set to be longer than the sampling period. According to an example embodiment, the sampling period may be set to be less than or equal to 1.5 horizontal periods. As an example, a horizontal period may refer to the time for driving one horizontal row (e.g., gate line) of pixels. Also, according to an example embodiment, the offset voltage formation period may be set to be two to six times of the sampling period.

The non-display area IA may be provided along an edge of the substrate to surround the display area AA. One part of the non-display area IA may be provided on the substrate and may include a pad part connected to the data lines DL1 to DLp.

The timing controller 300 may align video data Idata input thereto to pixel-based digital data Pdata suitable for driving the light emitting display panel 100, and may generate a data control signal DCS from a timing synchronization signal TSS to supply the data control signal DCS to the data driving circuit 500.

The timing controller 300 may generate a gate control signal GCS including a gate start signal, a plurality of gate clocks, a plurality of carry clocks, a plurality of sampling clocks, and a plurality of initialization clocks, based on the timing synchronization signal TSS and may supply the gate control signal GCS to the gate driving circuit 700. The gate control signal GCS may be supplied to the gate driving circuit 700 via the pad part.

The data driving circuit 500 may be connected to the data lines DL1 to DLp provided in the light emitting display panel 100. The data driving circuit 500 may convert the pixel-based digital data Pdata into a pixel-based analog data voltage by using a plurality of reference gamma voltages based on the data control signal DCS supplied from the timing controller 300. The data driving circuit 500 may supply the pixel-based analog data voltage to a corresponding data line DL.

The gate driving circuit 700 is connected to the first to $m^{th}$ gate lines GL1 to GLm, the first to $m^{th}$ light emission control lines ECL1 to ECLm, the first to $m^{th}$ initialization control lines ICL1 to ICLm, and the first to $m^{th}$ sampling control lines SCL1 to SCLm, which are provided in the display area AA. The gate driving circuit 700 may provide, to each of the pixels P, control signals having voltage levels determined for the initialization period, the sampling period, the offset voltage formation period, the data writing period, and the light emission period of each pixel P on the basis of the gate control signal GCS. The control signals may include an initialization control signal, a sampling control signal, a scan control signal, and a light emission control signal.

According to an example embodiment, the gate driving circuit 700 generates a scan control signal having the same cycle and a cyclically shifted phase and sequentially supplies the scan control signal to the plurality of gate lines GL1 to GLm. The gate driving circuit 700 also generates an initialization control signal having the same cycle and a cyclically shifted phase, and sequentially supplies the initialization control signal to the plurality of initialization control lines ICL1 to ICLm. The gate driving circuit 700 additionally generates a sampling control signal having the same cycle and a cyclically shifted phase, and sequentially supplies the sampling control signal to the plurality of sampling control lines SCL1 to SCLm. The gate driving circuit 700 also generates a carry signal having the same cycle and a cyclically shifted phase. The gate driving circuit 700 additionally generates an emission control signal including a first gate-off voltage level and a second gate-off voltage level, which have different phase differences, on the basis of at least two different carry signals, and supplies the emission control signal to the first to $m^{th}$ light emission control lines ECL1 to ECLm.

The gate driving circuit 700 may be formed in left and/or right portions of the non-display area of the substrate along with a process of manufacturing a thin-film transistor of the pixel P. For example, the gate driving circuit 700 may be formed in the left portion of the non-display area of the substrate and may operate with a single feeding scheme to supply the scan control signal to the plurality of gate lines GL. As another example, the gate driving circuit 700 may be formed in the left and right portions of the non-display area of the substrate and may operate in a double feeding scheme to supply the scan control signal to the plurality of gate lines GL. As yet another example, the gate driving circuit 700 may be formed in the left and right portions of the non-display area of the substrate and may operate in a double feeding interlacing scheme to supply the scan control signal to the plurality of gate lines GL.

The light emitting display apparatus according to an example embodiment of the present disclosure may further include a level shifter unit 900 which level-shifts the gate control signal GCS.

The level shifter unit 900 may level-shift a high logic voltage of the gate control signal GCS to a gate-on voltage level on the basis of a gate-on voltage supplied from a gate-on voltage source and a gate-off voltage supplied from a gate-off voltage source. The level shifter unit 900 may also level-shift a low logic voltage of the gate control signal GCS to a gate-off voltage level. The level shifter unit 900 may provide the level-shifted high logic voltage and low logic voltage to the gate driving circuit 700. In an example, level shifter unit 900 may be built in the timing control unit 300, e.g., to be a part of the circuitry of this timing control unit 300.

Figure 2:
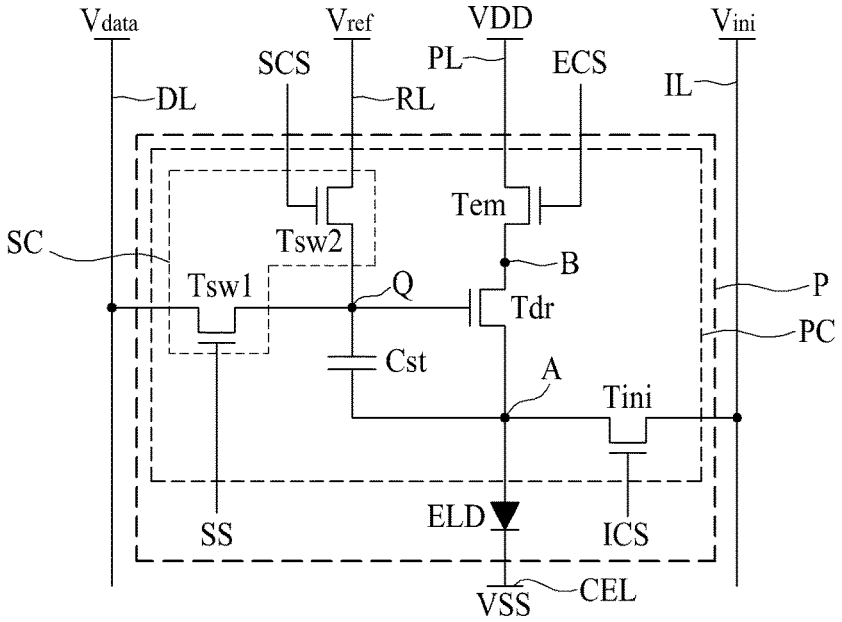
FIG. 2 is a view showing an example pixel shown in FIG. 1.

FIG. 2, which is a view showing an example pixel shown in FIG. 1, shows one pixel (or one sub-pixel) connected to any gate line and any data line of the light emitting display panel 100.

With reference to FIGS. 1 and 2, according to an example embodiment of the present disclosure, the pixel P may include a pixel circuit PC and a light emitting device ELD.

The light emitting device ELD may be interposed between a first electrode (e.g., an anode electrode) connected to the pixel circuit PC and a second electrode (e.g., a cathode electrode) connected to the cathode electrode layer CEL. According to an example embodiment, the light emitting device ELD may include an organic light emitting unit, a quantum dot light emitting unit, or an inorganic light emitting unit or may include a micro light emitting diode device. The light emitting device ELD emits light by a data current supplied from the pixel circuit PC.

The pixel circuit PC may be connected to the gate line GL, the light emission control line ECL, the initialization control line ICL, the sampling control line SCL, the data line DL, the pixel driving voltage line PL, the initialization voltage line IL, and the reference voltage line RL, and may supply, to the light emitting device ELD, a data current corresponding to a data voltage Vdata supplied to the data line DL.

The pixel circuit PC may include a driving transistor Tdr, an initialization transistor Tini, an emission control transistor Tem, a switching circuit SC (or a switching unit), and a storage capacitor Cst.

The driving transistor Tdr may be connected between the pixel driving voltage line PL and the light emitting device ELD, and be switched according to the voltage of the storage capacitor Cst to control a current flowing from the pixel driving voltage line PL to the light emitting device ELD. According to an example embodiment, the driving transistor Tdr may include a gate electrode electrically connected to a first pixel node Q, a source electrode electrically connected to a second pixel node A, and a drain electrode electrically connected to a third pixel node B.

The initialization transistor Tini may supply, to a second pixel node A connected to the source electrode of the driving transistor Tdr, an initialization voltage Vini supplied from the initialization voltage line IL in response to the initialization control signal ICS. That is, the initialization transistor Tini may be turned on by the initialization control signal of the gate-on voltage level supplied during the initialization period to supply the initialization voltage Vini to the second pixel node A. According to an example embodiment, the initialization transistor Tini may include a gate electrode electrically connected to an adjacent initialization control line ICL, a first source/drain electrode electrically connected to the initialization voltage line, and a second source/drain electrode electrically connected to the second pixel node A. The initialization transistor Tini may be turned on during only the initialization period according to the initialization control signal ICS.

The emission control transistor Tem may supply, to a third pixel node B connected to the drain electrode of the driving transistor Tdr, the pixel driving voltage VDD supplied from the pixel driving voltage line PL in response to the emission control signal ECS. That is, the emission control transistor Tem may be turned off by the emission control signal ECS of the gate-off voltage level supplied during the initialization period and the data writing period to block the pixel driving voltage VDD supplied to the third pixel node B, and may be turned on by the emission control signal ECS of the gate-on voltage level supplied during the sampling period, the offset voltage formation period, and the light emission period to supply the pixel driving voltage to the third pixel node B.

According to an example embodiment, the emission control transistor Tem may include a gate electrode electrically connected to an adjacent light emission control line ECL, a first source/drain electrode electrically connected to the pixel driving voltage line PL, and a second source/drain electrode electrically connected to the third pixel node B. According to the emission control signal ECS, the emission control transistor Tem may be turned off during the initialization period and the data writing period, and may be turned on during the sampling period, the offset voltage formation period, and the light emission period.

The switching circuit SC may supply the reference voltage Vref or the data voltage Vdata to the first pixel node Q. That is, the switching circuit SC may supply the reference voltage Vref to the first pixel node Q during the initialization period and the sampling period, and may supply the data voltage Vdata to the first pixel node Q during the data writing period. According to an example embodiment, the switching circuit SC may include a first switching transistor Tsw1 that supplies the data voltage Vdata to the first pixel node Q and a second switching transistor Tsw2 that supplies the reference voltage Vref to the first pixel node Q.

The first switching transistor Tsw1 may supply, to the first pixel node Q, actual data voltage Vdata supplied from the data line DL in response to the scan control signal SS. That is, the first switching transistor Tsw1 may be turned on by the scan control signal SS of the gate-on voltage level supplied during the data writing period to supply the actual data voltage Vdata to the first pixel node Q. According to an example embodiment, the first switching transistor Tsw1 may include a gate electrode electrically connected to an adjacent gate line GL, a first source/drain electrode electrically connected to an adjacent data line DL, and a second source/drain electrode electrically connected to the first pixel node Q. The first switching transistor Tsw1 may be turned on during only the data writing period according to the scan control signal SS.

The second switching transistor Tsw2 may supply, to the first pixel node Q, the reference voltage Vref supplied from the reference voltage line RL in response to the sampling control signal SCS. That is, the second switching transistor Tsw2 may be turned on by the sampling control signal SCS of the gate-on voltage level supplied during the initialization period and the sampling period to supply the reference voltage Vref to the first pixel node Q. According to an example embodiment, the second switching transistor Tsw2 may include a gate electrode electrically connected to an adjacent sampling control line SCL, a first source/drain electrode electrically connected to the first pixel node Q, and a second source/drain electrode electrically connected to a reference voltage line RL. The second switching transistor Tsw2 may be turned on during only the initialization period and the sampling period according to the sampling control signal SCS.

For the driving transistor Tdr, the first and second switching transistors Tsw1 and Tsw2, the initialization transistor Tini, and the emission control transistor Tem, the first source/drain electrodes and the second source/drain electrodes may be defined as source electrodes or drain electrodes depending on the direction of current.

Each of the driving transistors Tdr, the first and second switching transistors Tsw1 and Tsw2, the initialization transistor Tini, and the emission control transistor Tem has a semiconductor layer containing an oxide semiconductor material such as zinc oxide (ZnO), indium zinc oxide (InZnO) or indium gallium zinc oxide ($InGaZnO_4$). However, the example embodiments are not limited thereto, and the semiconductor layer may contain a monocrystalline silicon, polycrystalline silicon, or organic material other than the oxide semiconductor material.

Each of the driving transistors Tdr, the first and second switching transistors Tsw1 and Tsw2, the initialization transistor Tini, and the emission control transistor Tem may be an n-type thin-film transistor. However, example embodiments are not limited thereto, and each of the driving transistor Tdr, the first and second switching transistors Tsw1 and Tsw2, the initialization transistor Tini, and the emission control transistor Tem may be a p-type thin-film transistor.

The storage capacitor Cst is connected between the first pixel node Q and the second pixel node A. That is, the storage capacitor Cst is connected between the gate electrode and the source electrode of the driving transistor Tdr. The storage capacitor Cst stores a differential voltage between the voltage of the first pixel node Q and the voltage of the second pixel node A, which changes according to operational timing of the pixel P, stores the data voltage minus the reference voltage Vref and the data offset voltage Voffset (Vdata−Vref−Voffset), and switches the driving transistor Tdr with the stored voltage. The storage capacitor Cst is provided in an overlapping area between the first pixel node Q and the second pixel node A. The storage capacitor Cst may include a first capacitor electrode electrically connected to the first pixel node Q, a second capacitor electrode that overlaps the first capacitor electrode and is electrically connected to the second pixel node A, and a capacitance layer disposed between the first capacitor electrode and the second capacitor electrode. Here, the characteristic voltage of the driving transistor Tdr may include a threshold voltage.

Figure 3:
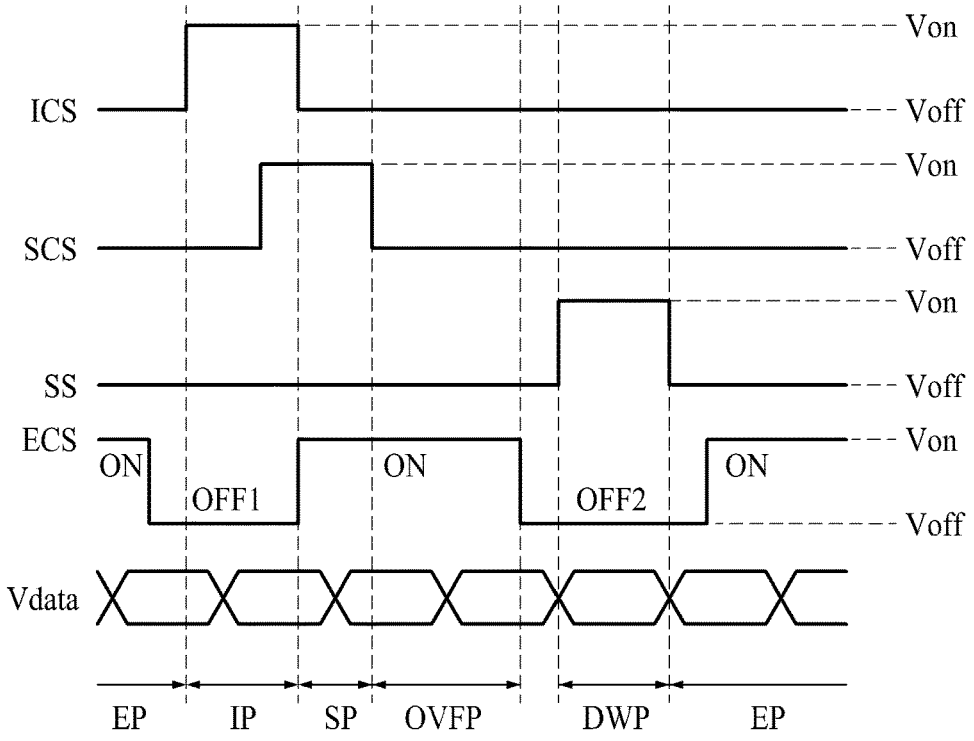
FIG. 3 is an operational timing diagram illustrating operation of the pixel shown in FIG. 2.

FIG. 3 is an operational timing diagram illustrating operation of the pixel shown in FIG. 2.

With reference to FIGS. 1 to 3, the pixel P according to an example embodiment of the present disclosure may operate in order of an initialization period IP, a sampling period (or a compensation period) SP, an offset voltage formation period OVFP, a data writing period (or a data programming period) DWP, and a light emission period EP.

In the initialization period IP, first, the storage capacitor Cst may be initialized by the initialization voltage Vini supplied to the initialization voltage line IL. Also in the initialization period IP, the reference voltage Vref is supplied to the reference voltage line RL in response to the emission control signal ECS of the first gate-off voltage level Voff, and the initialization control signal ICS and the sampling control signal SCS of the gate-on voltage level Von. That is, in the initialization period IP, the emission control transistor Tem may be turned off (OFF1) by the emission control signal ECS of the first gate-off voltage level Voff, and the initialization transistor Tini may be turned on by the initialization control signal ICS of the gate-on voltage level Von to supply the initialization voltage Vini to the second pixel node A. Subsequently, the second switching transistor Tsw2 may be turned on by the sampling control signal SCS of the gate-on voltage level Von to supply the reference voltage Vref to the first pixel node Q, and the first switching transistor Tsw1 may maintain a turn-off state by the scan control signal SS of the gate-off voltage level Voff. Thus, the storage capacitor Cst may be initialized with an initialization voltage corresponding to a differential voltage between the initialization voltage Vini and the reference voltage Vref.

In the sampling period SP, a sampling voltage corresponding to the threshold voltage of the driving transistor Tdr may be stored in the storage capacitor Cst by the pixel driving voltage VDD supplied to the pixel driving voltage line PL and the reference voltage Vref supplied to the reference voltage line RL in response to the sampling control signal SCS of the gate-on voltage level Von and the emission control signal ECS of the gate-on voltage level Von. Also in the sampling period SP, the emission control transistor Tem may be turned on (ON) by the emission control signal ECS of the gate-on voltage level Von, the initialization transistor Tini may be turned off by the initialization control signal ICS of the gate-off voltage level Voff, the second switching transistor Tsw2 may maintain a turn-on state by the sampling control signal SCS of the gate-on voltage level Von, and the first switching transistor Tsw1 may maintain a turn-off state by the scan control signal SS of the gate-off voltage level Voff. Thus, the reference voltage Vref may be supplied to the first pixel node Q through the second switching transistor Tsw2, and the second pixel node A may be electrically floated according to the initialization transistor Tini being turned off. Accordingly, the driving transistor Tdr may be turned on by the reference voltage Vref of the first pixel node Q to operate as a source follower, and when a source voltage is a voltage "Vref−$V_{TH}$" obtained by subtracting the threshold voltage $V_{TH}$ of the driving transistor Tdr from the reference voltage Vref, the driving transistor Tdr may be turned off, and thus a sampling voltage (or a compensation voltage) corresponding to the threshold voltage of the driving transistor Tdr may be charged into the storage capacitor Cst. For example, a voltage close to the threshold voltage $V_{TH}$ of the driving transistor Tdr or a differential voltage (Vref-$V_{TH}$) between the threshold voltage $V_{TH}$ of the driving transistor Tdr and the reference voltage Vref may be charged into the storage capacitor Cst. In the sampling period SP, a variation in sampling voltage ΔV (hereinafter referred to as a sampling voltage variation ΔV) may occur due to a threshold voltage variation $\Delta V_{TH}$ between the pixels P.

In the offset voltage formation period OVFP, a data offset voltage corresponding to a current flowing through the driving transistor Tdr may be formed at the first pixel node Q by the pixel driving voltage VDD supplied from the pixel driving voltage line PL to the third pixel node B and the sampling voltage stored in the storage capacitor Cst in response to the emission control signal ECS of the gate-on voltage level Von. Also, in the offset voltage formation period OVFP, the emission control transistor Tem may maintain a turn-on state (ON) by the emission control signal ECS of the gate-on voltage level Von, the initialization transistor Tini may maintain a turn-off state by the initialization control signal ICS of the gate-off voltage level Voff, the second switching transistor Tsw2 may be turned off by the sampling control signal SCS of the gate-off voltage level Voff, and the first switching transistor Tsw1 may maintain a turn-off state by the scan control signal SS of the gate-off voltage level Voff. Thus, the first pixel node Q may become an electrically high impedance (or floating) state since the supply of the reference voltage Vref may be blocked. Also, the voltage of the second pixel node A may vary depending on a sampling current flowing through the driving transistor Tdr that is turned on by the sampling voltage stored in the storage capacitor Cst. Also, the voltage of the first pixel node Q, which may be in the high impedance state, may be changed (or shifted) to a voltage including the data offset voltage Voffset according to voltage coupling (or bootstrapping) of the storage capacitor Cst due to a variation in potential of the second pixel node A. As an example, in the offset voltage formation period OVFP, the final voltage of the first pixel node Q may be higher than the final voltage of the sampling period SP, and for example, may be a voltage obtained by adding the reference voltage Vref and the data offset voltage Voffset (Vref+Voffset). In the offset voltage formation period OVFP, the voltage of the second pixel node A may vary depending on the sampling voltage variation ΔV.

In the data writing period DWP, the data voltage Vdata supplied from the data line DL may be supplied to the first pixel node Q in response to the scan control signal SS of the gate-on voltage level Von and the emission control signal ECS of the second gate-off voltage level Voff.

In the data writing period DWP, the first switching transistor Tsw1 may be turned on by the scan control signal SS of the gate-on voltage level Von, the emission control transistor Tem may be turned off (OFF2) by the emission control signal ECS of the second gate-off voltage level Voff, the second switching transistor Tsw2 may maintain a turn-off state by the sampling control signal SCS of the gate-off voltage level Voff, and the initialization transistor Tini may maintain a turn-off state by the initialization control signal ICS of the gate-off voltage level Voff. Also, the actual data voltage Vdata may be supplied from the data driving circuit to the data line DL. Thus, the actual data voltage Vdata may be supplied to the first pixel node Q through the first switching transistor Tsw1, and the second pixel node A may electrically maintain a floating state according to the initialization transistor Tini being turned off. Accordingly, a voltage of the first pixel node Q may be shifted from a voltage obtained by adding the reference voltage Vref and the data offset voltage Voffset to the actual data voltage Vdata (Vref+Voffset), the first pixel node Q may be shifted in voltage obtained by subtracting the reference voltage Vref and the data offset voltage Voffset from the actual data voltage Vdata (Vdata−Vref−Voffset), as expressed in the following Equation (1). That is, the pixel driving voltage VDD that has been supplied to the driving transistor Tdr may be blocked by turning off the emission control transistor Tem, and thus no current flows through the driving transistor Tdr. When the actual data voltage Vdata is applied to the first pixel node Q in a state in which no current flows in the driving transistor Tdr, a voltage proportional to the data voltage obtained by subtracting the reference voltage Vref and the data offset voltage Voffset from the actual data voltage Vdata (Vdata-Vref-Voffset) may be additionally added to the storage capacitor Cst by coupling due to a change in voltage of the first pixel node Q. Thus, the sampling voltage variation ΔV between the pixels P may be removed by a change in voltage of the storage capacitor Cst (or a change in voltage between the first pixel node Q and the second pixel node A). In this case, the voltage additionally added to the storage capacitor Cst may be represented as a voltage such as an expression α(Vdata−Vref−Voffset), which may be coupled to a change in voltage of the first pixel node Q. Here, α (alpha) refers to a transfer rate.

$$\Delta V_Q = V_{data} - (V_{ref} + V_{offset}) \quad (1)$$

In the light emission period EP, the light emitting device ELD may emit light by the voltage of the storage capacitor Cst and the pixel driving voltage VDD in response to the emission control signal ECS of the gate-on voltage level Von.

In the light emission period EP, the emission control transistor Tem may be turned on (ON) by the emission control signal ECS of the gate-on voltage level Von, the first switching transistor Tsw1 may be turned off by the scan control signal SS of the gate-off voltage level Voff, and the second switching transistor Tsw2 and the initialization transistor Tini may maintain a turn-off state by corresponding control signals SCS and ICS of the gate-off voltage level Voff. Thus, the voltage stored in the storage capacitor Cst may be supplied to the first pixel node Q, and the pixel driving voltage VDD may be supplied to the drain electrode of the driving transistor Tdr through the emission control transistor Tem. Accordingly, the source voltage (e.g., the voltage of the second pixel node) may be increased by enabling a current to flow through the driving transistor Tdr, the voltage of the storage capacitor Cst may be maintained, and the gate voltage of the driving transistor Tdr (e.g., the voltage of the first pixel node) may be increased in coupling with the increase in voltage of the second pixel node. Thus, the threshold voltage variation between the pixels P may be cancelled by the change in voltage of the storage capacitor Cst (or the change in voltage between the first pixel node Q and the second pixel node A). As a result, a source current flowing through the driving transistor Tdr (a data current supplied to the light emitting device) depends on only the actual data voltage and the reference voltage and is not affected by the threshold voltage of the driving transistor Tdr.

As described above, the light emitting display apparatus according to an example embodiment of the present disclosure may form the data offset voltage at the gate electrode of the driving transistor through the offset voltage formation period of each pixel between the sampling period and the data writing period. Accordingly, it may be possible to compensate for a sampling voltage variation between pixels as well as a threshold voltage variation between driving transistors provided in the pixels, and thus to decrease the sampling voltage variation between the pixels caused by the threshold voltage variation between the driving transistors provided in the pixels.

Figure 4:
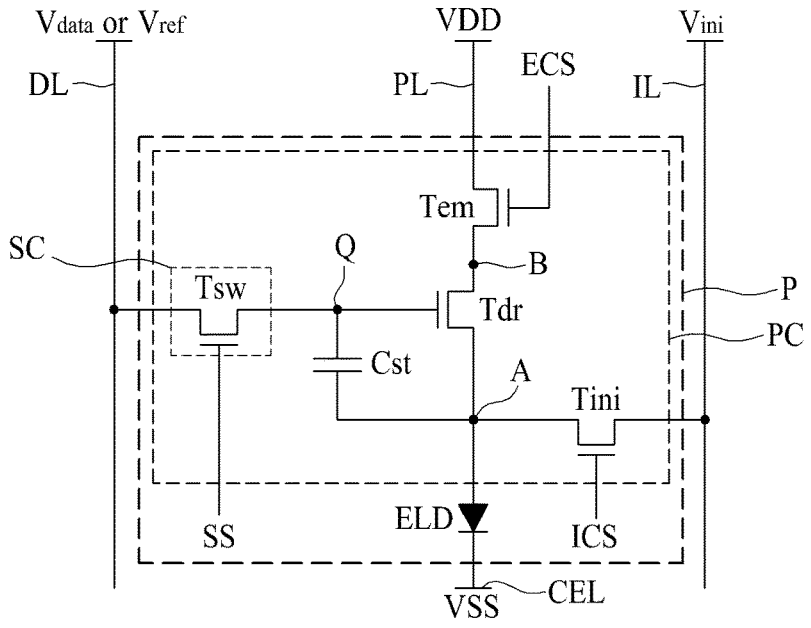
FIG. 4 is a view showing another example pixel shown in FIG. 1.

FIG. 4 is a view showing another example pixel shown in FIG. 1, in which the switching circuit SC of the pixel circuit PC shown in FIG. 2 is changed. Thus, only the switching circuit and its associated elements will be described below, and a redundant description of the remaining elements will be omitted.

Figure 5:
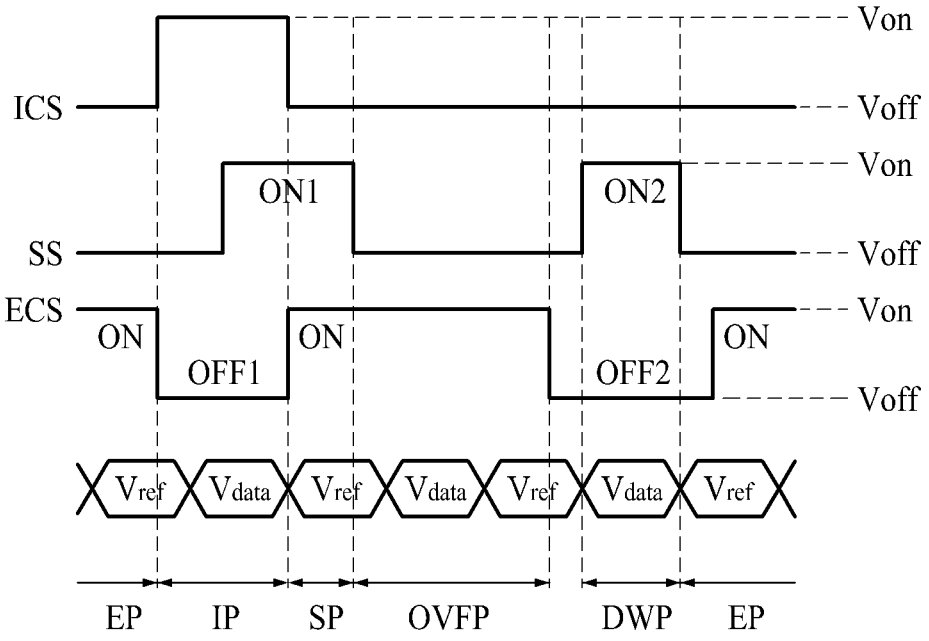
FIG. 5 is an operational timing diagram illustrating operation of the pixel shown in FIG. 4.

FIG. 5 is an operational timing diagram illustrating operation of the pixel shown in FIG. 4.

With reference to FIGS. 1, 4, and 5, the switching circuit SC of the pixel circuit PC provided in the pixel P according to the present example embodiment may be turned on during the initialization period and the sampling period to supply the reference voltage Vref to the first pixel node Q, and may be turned on during the data writing period to supply the data voltage Vdata to the first pixel node Q. According to an example embodiment, the switching circuit SC may include a switching transistor Tsw.

In response to the scan control signal SS, the switching transistor Tsw may supply, to the first pixel node Q, the reference voltage Vref supplied from the data line DL and may then supply, to the first pixel node Q, the actual data voltage Vdata supplied from the data line DL. That is, the switching transistor Tsw may be turned on (ON1) by the scan control signal SS of a first gate-on voltage level supplied during the initialization period and the sampling period, to supply the reference voltage Vref to the first pixel node Q, and may then be turned on (ON2) by the scan control signal SS of a second gate-on voltage level supplied during the data writing period, to supply the actual data voltage Vdata to the first pixel node Q. According to an example embodiment, the switching transistor Tsw may include a gate electrode electrically connected to an adjacent gate line GL, a first source/drain electrode electrically connected to an adjacent data line DL, and a second source/drain electrode electrically connected to the first pixel node Q. The switching transistor Tsw may be turned on during only the initialization period, the sampling period, and the data writing period according to the scan control signal SS.

The light emitting display apparatus including the switching circuit SC may switch the switching transistor Tsw according to the scan control signal SS and may sequentially supply, to the first pixel node Q, the reference voltage Vref and the actual data voltage Vdata sequentially supplied from the data line DL according to the switching of the switching transistor Tsw. Thus, by omitting the plurality of sampling control lines SCL1 to SCLm and the plurality of reference voltage lines RL1 to RLm provided in the light emitting display panel 100 shown in FIG. 1, and also omitting a circuit for supplying the sampling control signal to the plurality of sampling control lines SCL1 to SCLm of the gate driving circuit 700, it may be possible to decrease the size of the gate driving circuit 700 and the numbers of control lines and voltage lines formed in the light emitting display panel 100.

The data driving circuit 500 shown in FIG. 1 may alternately supply the reference voltage Vref and the actual data voltage Vdata to the data line DL in units of one (1) horizontal period or 1.5 horizontal periods.

Also, the gate driving circuit 700 may provide, to each of the pixels P, an initialization control signal, a scan control signal, and an emission control signal having voltage levels determined for the initialization period, the sampling period, the offset voltage formation period, the data writing period, and the light emission period of each pixel P on the basis of the gate control signal GCS.

The gate driving circuit 700 may generate a scan control signal having the same cycle and a cyclically shifted phase and may sequentially supply the scan control signal to the plurality of gate lines GL1 to GLm. The gate driving circuit 700 may also generate an initialization control signal having the same cycle and a cyclically shifted phase and may sequentially supply the initialization control signal to the plurality of initialization control lines ICL1 to ICLm. The gate driving circuit 700 may additionally generate a carry signal having the same cycle and a cyclically shifted phase. The gate driving circuit 700 may also generate an emission control signal including a first gate-off voltage level and a second gate-off voltage level, which have different phase differences, on the basis of at least two different carry signals. The gate driving circuit 700 may additionally supply the emission control signal to the first to $m^{th}$ light emission control lines ECL1 to ECLm.

With reference to FIGS. 1, 4, and 5, the pixel P according to an example embodiment of the present disclosure may operate in order of the initialization period IP, the sampling period (or the compensation period) SP, the offset voltage formation period OVFP, the data writing period (or the data programming period) DWP, and the light emission period EP.

In the initialization period IP, first, the storage capacitor Cst may be initialized by the initialization voltage Vini supplied to the initialization voltage line IL and the reference voltage Vref supplied to the data line DL in response to the initialization control signal ICS of the gate-on voltage level Von, the scan control signal SS of the first gate-on voltage level Von, and the emission control signal ECS of the first gate-off voltage level Voff. That is, in the initialization period IP, the emission control transistor Tem may be turned off (OFF1) by the emission control signal ECS of the first gate-off voltage level Voff, and the initialization transistor Tini may be turned on by the initialization control signal ICS of the gate-on voltage level Von to supply the initialization voltage Vini to the second pixel node A. Subsequently, the switching transistor Tsw may be turned on (ON1) by the scan control signal SS of the first gate-on voltage level Von to supply the reference voltage Vref to the first pixel node Q. Thus, the storage capacitor Cst may be initialized with an initialization voltage corresponding to a differential voltage between the initialization voltage Vini and the reference voltage Vref.

In the sampling period SP, a sampling voltage corresponding to the threshold voltage of the driving transistor Tdr may be stored in the storage capacitor Cst by the pixel driving voltage VDD supplied to the pixel driving voltage line PL and the reference voltage Vref supplied to the data line DL in response to the scan control signal SS of the first gate-on voltage level Von and the emission control signal ECS of the gate-on voltage level Von.

In the sampling period SP, the emission control transistor Tem may be turned on by the emission control signal ECS of the gate-on voltage level Von, the initialization transistor Tini may be turned off by the initialization control signal ICS of the gate-off voltage level Voff, and the switching transistor Tsw may be turned on by the scan control signal SS of the gate-on voltage level Von. Thus, the reference voltage Vref may be supplied to the first pixel node Q through the switching transistor Tsw, and the second pixel node A may be electrically floated according to the initialization transistor Tini being turned off. Accordingly, the driving transistor Tdr may be turned on by the reference voltage Vref of the first pixel node Q to operate as a source follower, and when a source voltage is a voltage "Vref–$V_{TH}$" obtained by subtracting the threshold voltage $V_{TH}$ of the driving transistor Tdr from the reference voltage Vref, the driving transistor Tdr may be turned off, and thus a sampling voltage (or a compensation voltage) corresponding to the threshold voltage of the driving transistor Tdr may be charged into the storage capacitor Cst. For example, a voltage close to the threshold voltage $V_{TH}$ of the driving transistor Tdr or a differential voltage (Vref–$V_{TH}$) between the threshold voltage $V_{TH}$ of the driving transistor Tdr and the reference voltage Vref may be charged into the storage capacitor Cst. In the sampling period SP, a variation in sampling voltage ΔV (hereinafter referred to as a sampling voltage variation ΔV) may occur due to a threshold voltage variation $\Delta V_{TH}$ between the pixels P.

In the offset voltage formation period OVFP, a data offset voltage corresponding to a current flowing through the driving transistor Tdr may be formed at the first pixel node Q by the pixel driving voltage VDD supplied from the pixel driving voltage line PL to the third pixel node B and the sampling voltage stored in the storage capacitor Cst in response to the emission control signal ECS of the gate-on voltage level Von.

In the offset voltage formation period OVFP, the emission control transistor Tem may maintain a turn-on state by the emission control signal ECS of the gate-on voltage level Von, the initialization transistor Tini may maintain a turn-off state by the initialization control signal ICS of the gate-off voltage level Voff, and the switching transistor Tsw may maintain a turn-off state by the scan control signal SS of the gate-off voltage level Voff. Thus, the first pixel node Q may become an electrically high impedance (or floating) state since the supply of the reference voltage Vref may be blocked. Furthermore, the voltage of the second pixel node A may vary depending on a sampling current flowing through the driving transistor Tdr that may be turned on by the sampling voltage stored in the storage capacitor Cst. Also, the voltage of the first pixel node Q, which is in the high impedance state, may be changed (or shifted) to a voltage including the data offset voltage Voffset according to voltage coupling (or bootstrapping) of the storage capacitor Cst due to a variation in potential of the second pixel node A. As an example, in the offset voltage formation period OVFP, the final voltage of the first pixel node Q may be higher than the final voltage of the sampling period SP, and for example, may be a voltage (Vref+Voffset) obtained by adding the reference voltage Vref and the data offset voltage Voffset. In the offset voltage formation period OVFP, the voltage of the second pixel node A may vary depending on the sampling voltage variation ΔV.

In the data writing period DWP, the data voltage Vdata supplied from the data line DL may be supplied to the first pixel node Q in response to the scan control signal SS of the second gate-on voltage level Von and the emission control signal ECS of the second gate-off voltage level Voff.

In the data writing period DWP, the switching transistor Tsw may be turned on (ON2) by the scan control signal SS of the second gate-on voltage level Von, the emission control transistor Tem may be turned off (OFF2) by the emission control signal ECS of the second gate-off voltage level Voff, and the initialization transistor Tini may maintain a turn-off state by the initialization control signal ICS of the gate-off voltage level Voff. Also, the actual data voltage Vdata may be supplied from the data driving circuit to the data line DL. Thus, the actual data voltage Vdata may be supplied to the first pixel node Q through the switching transistor Tsw, and the second pixel node A may electrically maintain a floating according to the initialization transistor Tini being turned off. Accordingly, a voltage of the first pixel node Q may be shifted from a voltage (Vref+Voffset) obtained by adding the reference voltage Vref and the data offset voltage Voffset to the actual data voltage Vdata, the first pixel node Q may be shifted in voltage (Vdata−Vref−Voffset) obtained by subtracting the reference voltage Vref and the data offset voltage Voffset from the actual data voltage Vdata as expressed in the above Equation (1). The change is the same as described above, and thus a redundant description thereof will be omitted.

In the light emission period EP, the light emitting device ELD may emit light by the voltage of the storage capacitor Cst and the pixel driving voltage VDD in response to the emission control signal ECS of the gate-on voltage level Von.

In the light emission period EP, the emission control transistor Tem may be turned on by the emission control signal ECS of the gate-on voltage level Von, the switching transistor Tsw may be turned off by the scan control signal SS of the gate-off voltage level Voff, and the initialization transistor Tini may maintain a turn-off state by the initialization control signal ICS of the gate-off voltage level Voff. Thus, the voltage stored in the storage capacitor Cst may be supplied to the first pixel node Q, and the pixel driving voltage VDD may be supplied to the drain electrode of the driving transistor Tdr through the emission control transistor Tem. Accordingly, the source voltage (e.g., the voltage of the second pixel node) may be increased by enabling a current to flow through the driving transistor Tdr, the voltage of the storage capacitor Cst may be maintained, and the gate voltage of the driving transistor Tdr (e.g., the voltage of the first pixel node) may be increased in coupling with the increase in voltage of the second pixel node. Thus, the threshold voltage variation between the pixels P may be cancelled by the change in voltage of the storage capacitor Cst (or the change in voltage between the first pixel node Q and the second pixel node A). As a result, a source current flowing through the driving transistor Tdr (a data current supplied to the light emitting device) depends on only the actual data voltage and the reference voltage, and is not affected by the threshold voltage of the driving transistor Tdr.

The light emitting display apparatus according to an example embodiment of the present disclosure may have the same effect as the pixel shown in FIG. 2.

Figure 6A:
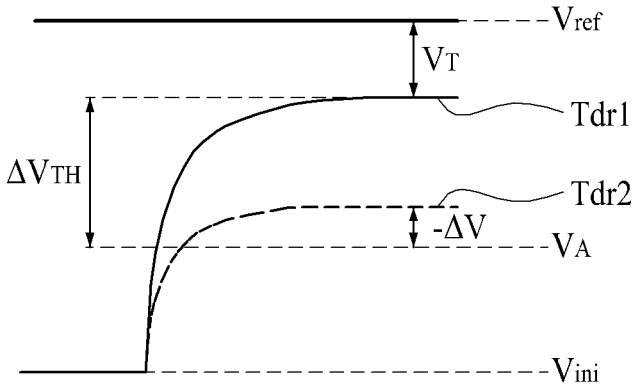
FIGS. 6A and 6B are views illustrating characteristics of a sampling period and an offset voltage formation period for two driving transistors having different threshold voltages, in a light emitting display apparatus according to an example embodiment of the present disclosure.
Figure 6B:
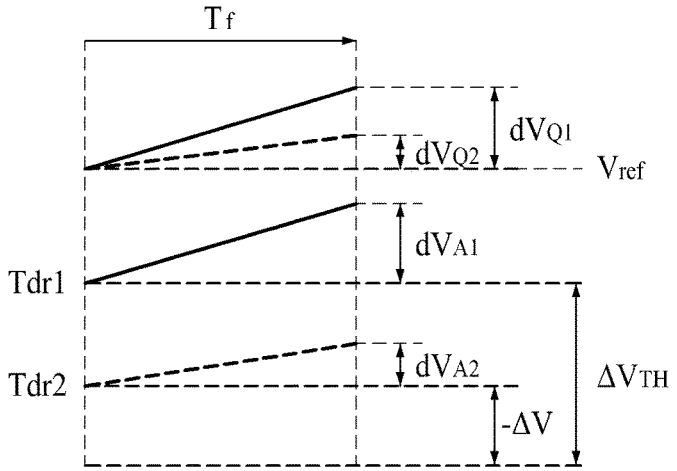

FIGS. 6A and 6B are views illustrating characteristics of the sampling period and the offset voltage formation period for two driving transistors having different threshold voltages, in the light emitting display apparatus according to an example embodiment of the present disclosure.

First, with reference to FIG. 6A, it is assumed that a first driving transistor Tdr1 and a second driving transistor Tdr2 have a threshold voltage variation of $\Delta V_{TH}$. When the characteristics of the second driving transistor Tdr2 are described with reference to the first driving transistor Tdr1, the threshold voltage $V_{TH}$ of the first driving transistor Tdr1 may be $V_T$+c, and the threshold voltage $V_{TH}$ of the second driving transistor Tdr2 may be $V_T+\Delta V_{TH}$+c. The current characteristics $I1(V_{gs})$ of the first driving transistor Tdr1 and the current characteristics $I2(V_{gs})$ of the second driving transistor Tdr2 may be expressed as Equation (2) below:

$$I1(V_{gs})=I_0g(V_{gs}-V_T),$$

$$I2(V_{gs})=I_0g(V_{gs}-V_T-\Delta V_{TH})$$

$$g(0)=1 \qquad (2),$$

where $V_T$ represents a sampling voltage, and Vgs represents a gate-source voltage.

In the sampling period of the pixel, the change in voltage $V_A$ of the second pixel node A may be expressed as Equation (3) below:

$$-C\frac{d(V_{ref}-V_A-V_T)}{dt}=I_0g(V_{ref}-V_A-V_T) \qquad (3)$$

where the reference voltage Vref and the sampling voltage $V_T$ may be constants, and C is the sum (Cst+Cp) of the capacitance Cst of the storage capacitor Cst and other parasitic capacitance Cp. Here, the other parasitic capacitance may include the capacitance of the auxiliary capacitor and/or the light emitting device.

Also, the current Id of the driving transistor Tdr after the sampling may be "$10^4C<Id<10^6C$."

For the first driving transistor Tdr1, when integration is performed during a sampling time $t_s$, the following Equation (4) may be obtained. Also, the sampling voltage $V_T$ may be obtained using Equation (4) below:

$$\int_0^{Vi}\frac{dV}{g(V)}=\frac{I_0}{C}t_s\equiv fg\ Vi=V_{ref}-V_{ini}-V_T. \qquad (4)$$

After the sampling period, by using the threshold voltage variation $\Delta V_{TH}$ and the sampling voltage variation ΔV for the first driving transistor Tdr1, the gate-source voltage $V_{gs}$ and the gate current $I_0g(\Delta V)$ of the second driving transistor Tdr2 may be expressed as Equation (5) below:

$$V_{gs}=V_T+\Delta V_{TH}+\Delta V$$

$$I=I_0g(\Delta V). \qquad (5)$$

Accordingly, in Equation (5), there is a threshold voltage variation between the driving transistors of the pixels, and thus the sampling voltage variation ΔV may occur during the sampling period, and the sampling voltage variation ΔV may be compensated for during the above-described offset voltage formation period.

With reference to FIG. 6B, when the pixel driving voltage is applied to the drain electrode of the driving transistor during the offset voltage formation period, the reference voltage Vref supplied to the first pixel node Q may be blocked. Thus, the gate electrode (or the first pixel node) of the driving transistor during the offset voltage formation period $t_f$ is in the high impedance state, the voltage of the source electrode (or the second pixel node) of the driving transistor changes by a current flowing through the driving transistor due to the pixel driving voltage, as expressed in the following Equation (6), and the change in voltage $dV_A$ of the second pixel node A varies depending on the sampling voltage variation ΔV.

$$dV_A=\frac{1}{C}I_0g(\Delta V)t_f. \qquad (6)$$

As the reference voltage Vref supplied to the first pixel node Q is blocked, a change in voltage $\Delta(V_Q-V_A)$ between the first pixel node Q and the second pixel node A while no current flows through the first pixel node Q may be expressed as Equation (7) below:

$$\Delta(V_Q-V_A)\approx-\eta(\Delta V_A) \qquad (7)$$

where $\eta$ is a reverse transfer rate of the driving transistor, and $\Delta(V_A)$ is a change in voltage of the second pixel node A.

Considering the reverse transfer rate $\eta$ of the driving transistor, a change in voltage $dV_{QA}$ between the first pixel node Q and the second pixel node A may be expressed as Equation (8) below:

$$dV_{QA} \cong -\eta \frac{1}{C} I_0 g(\Delta V) t_f. \tag{8}$$

Also, in the offset voltage formation period, the data offset voltage Voffset may be formed according to the reverse transfer rate $\eta$ of the driving transistor in Equation (7) and the change in voltage of the second pixel node A in Equation (6), as Equation (9) below:

$$V_{offset} = (1-\eta) \frac{1}{C} I_0 g(\Delta V) t_f. \tag{9}$$

Since a current flows through the driving transistor according to the change in voltage $dV_{QA}$ between the first pixel node Q and the second pixel node A, which occurs during the offset voltage formation period, the gate-source voltage of the driving transistor may gradually decrease and change, but a difference in current due to the change in voltage is negligible and thus may be ignored.

Accordingly, by the change in voltage between the first pixel node Q and the second pixel node A being added during the offset voltage formation period, the voltage of the storage capacitor Cst, that is, the gate-source voltage $V_{gs}$ of the driving transistor may be expressed as Equation (10) below:

$$V_{gs} = V_T + \Delta V_{TH} + \Delta V + dV_{QA}. \tag{10}$$

During the data writing period after the offset voltage formation period, the pixel driving voltage applied to the drain electrode of the driving transistor may be blocked, and the data voltage Vdata may be applied to the first pixel node Q. Thus, the change in voltage $\Delta V_Q$ of the first pixel node Q may be expressed as Equation (11), which may be affected by the offset voltage Voffset programmed during the offset voltage formation period, below:

$$\begin{aligned} \Delta V_q &= V_{data} - (V_{ref} + V_{offset}) \\ V_{offset} &= (1-\eta) \frac{1}{C} I_0 g(\Delta V) t_f. \end{aligned} \tag{11}$$

During the data writing period, the pixel driving voltage applied to the drain electrode of the driving transistor may be blocked. Thus, while no current flows through the driving transistor, the change in voltage $\Delta(V_Q - V_A)$ between the first pixel node Q and the second pixel node A may be expressed as the following Equation (12). When a current flows into the second pixel node A during the data writing period, the change in voltage of the second pixel node A generates an error. Accordingly, according to example embodiments of the present disclosure, the data writing period proceeds while no current flows into the second pixel node A.

$$\Delta(V_Q - V_A) \cong \alpha(\Delta V_Q) \tag{12}$$

where $\Delta V_Q$ is the change in voltage of the first pixel node Q, and $\alpha$ is the transfer rate.

The transfer rate $\alpha$ may be determined by the capacitance ~Cp/(Cp+Cst) of the pixel, regardless of the transistor characteristics. Considering the transfer rate $\alpha$, by the change in voltage $\Delta V_Q$ of the first pixel node Q being coupled and added, the voltage of the storage capacitor Cst, that is, the gate-source voltage $V_{gs}$ of the driving transistor while no current flows through the driving transistor may be expressed as Equation (13) below:

$$\begin{aligned} V_{gs} &= \alpha(V_{data} - (V_{ref} + V_{offset})) + dV_{QA} + V_T + \Delta V_{TH} + \Delta V \\ &= \alpha(V_{data} - V_{ref}) + V_T + \Delta V_{TH} + dV \\ dV &= \Delta V - (\alpha + \eta - \alpha\eta) \frac{1}{C} I_0 g(\Delta V) t_f. \end{aligned} \tag{13}$$

As expressed in Equation (13), the voltage added to the storage capacitor Cst during the data writing period for the pixel may be represented as $\alpha$(Vdata−Vref−Voffset). Thus, the data offset voltage Voffset, for compensating for the sampling voltage variation $\Delta V$ between the pixels may be programmed (or set) to satisfy conditions of Equation (14) below:

$$\alpha V_{offset} = \Delta V + c_1 + o(\Delta V)^2 \tag{14}$$

where $c_1$ is a constant, and $o(\Delta V)^2$ is a second order function for the sampling voltage variation $\Delta V$. Optionally, Equation (14) may include a variation other than the sampling voltage variation $\Delta V$, and this case may also be cancelled.

Also, the voltage Vcst stored in the storage capacitor Cst after the sampling period, the offset voltage formation period, and the data writing period may be expressed as Equation (15) below:

$$V_{cst} = \alpha(V_{data} - V_{ref}) + V_T + \Delta V_{TH} + c_2 \tag{15}$$

where $c_2$ is a constant.

According to an example embodiment of the present disclosure, as expressed in Equation (16), the current and voltage of the driving transistor after the data writing period of each pixel may have a difference caused by the sampling voltage variation $\Delta V$ corresponding to the threshold voltage $V_{TH}$ ($V_T + \Delta V_{TH} + c$). The difference may be expressed as the following Equation (18) when the offset voltage formation period $t_f$ is set to an optimal offset voltage formation time $t_0$ so that the voltage at the left side is equal to the voltage at the right side in the following Equation (17).

$$\begin{aligned} I(V_{gs}) &= I_0 g(\alpha(V_{data} - V_{ref}) + dV) \\ dV &= \Delta V - (\alpha + \eta - \alpha\eta) \frac{1}{C} I_0 g(\Delta V) t_f \end{aligned} \tag{16}$$

$$\begin{aligned} dV &= \Delta V - (\alpha + \eta - \alpha\eta) \frac{1}{C} I_0 t_f (1 + g'(0)\Delta V + o((\Delta V)^2)) \\ \Delta V &\cong (\alpha + \eta - \alpha\eta) \frac{1}{C} I_0 t_0 (g'(0)\Delta V)) \\ dV &= c + o(\Delta V)^2 \ (@ t_f = t_0) \end{aligned} \tag{17}$$

$$\begin{aligned} 1 &= (\alpha + \eta - \alpha\eta) \frac{1}{C} I_0 t_0 g'(0) \\ t_0 &= \frac{1}{(\alpha + \eta - \alpha\eta)} \frac{C}{I_0 g'(0)} \\ dV &= -(\alpha + \eta - \alpha\eta) \frac{1}{C} I_0 t_0 + o(\Delta V)^2 = -\frac{1}{g'(0)} + o(\Delta V)^2. \end{aligned} \tag{18}$$

Accordingly, the current $I(V_{gs})$ of the driving transistor is independent of the variation in threshold voltage $\Delta V_{TH}$, as expressed in Equation (19) below:

$$I(V_{gs})=I_0 g(\alpha(V_{data}-V_{ref})-g'(0)^{-1}). \tag{19}$$

According to an example embodiment of the present disclosure, during the offset voltage formation period, the voltage of the first pixel node may vary depending on a noise voltage Vn (e.g., a kick back voltage) as well as the data offset voltage programmed according to the current. In this case, the noise voltage Vn may be added to the expressions of the data offset voltage Voffset, such as Equation (9) and Equation (10). In this case, the gate-source voltage $V_{gs}$ of the driving transistor changes by "transfer rate×Vn," but the change may be cancelled during the data writing period. Also, the sampling current during the sampling period may vary depending on the change in gate-source voltage $V_{gs}$ of the driving transistor caused by the noise voltage Vn, which may be expressed as the change in sampling voltage $V_T$ of Equation (5).

According to an example embodiment of the present disclosure, when an additional voltage approximately linearly proportional to the threshold voltage of the driving transistor is added at the initial stage of the light emission period of each pixel, the data offset voltage Voffset may be set to compensate for (or subtract) the additional voltage $k\Delta V(\Delta V_{TH})$, as expressed in Equation (20) below:

$$\alpha V_{offset} \cong \Delta V + k\Delta V(\Delta V_{TH}) + c_1 \tag{20}$$

According to an example embodiment of the present disclosure, at the start point of the light emission period of the pixel (or during a settling period), a variation in voltage ($\beta\Delta V_{TH}$) may occur depending on the threshold voltage of the driving transistor, as expressed in the following Equation (21), in which β represents a constant value determined by the mobility and the parasitic capacitance of the driving transistor. Also, the variation in voltage may be compensated for by setting the data offset voltage Voffset to satisfy conditions for the optimal voltage formation time $t_0$ and a voltage variation ΔV of the following Equation (22).

$$\beta\Delta V_{TH}(=\beta g(Vi)\Delta V) \tag{21}$$

$$dV = (1+\beta g(Vi))\Delta V - (\alpha+\eta-\alpha\eta)\frac{1}{C}I_0 g(\Delta V)t_f \tag{22}$$

$$t_0 = \frac{(1+\beta g(Vi))}{(\alpha+\eta-\alpha\eta)}\frac{C}{I_0 g'(0)}$$

When a time t near the optimal offset voltage formation time according to example embodiments of the present disclosure is assumed as $t_0+\Delta t$, the sampling voltage variation ΔV corresponds to a gate voltage g(Vi) for the threshold voltage variation $\Delta V_{TH}$, and thus the voltage variation dV may be expressed as Equation (23) below:

$$\Delta V \cong -\frac{1}{g(Vi)}\Delta V_{TH} \tag{23}$$

$$dV = \Delta V - (\alpha+\eta-\alpha\eta)\frac{1}{C}I_0(t_0+\Delta t)(1+g'(0)\Delta V)$$

$$dV = \Delta V - (\alpha+\eta-\alpha\eta)\frac{1}{C}I_0(t_0+\Delta t+\Delta t g'(0)\Delta V)$$

-continued $$dV = -(\alpha+\eta-\alpha\eta)\frac{1}{C}I_0 t_0\left\{1-\left(1-\frac{g'(0)}{g(Vi)}\Delta V_{TH}\right)\frac{\Delta t}{t_0}\right\}.$$

The time t near the optimal offset voltage formation time and the threshold voltage variation $\Delta V_{TH}$, which assign a predetermined variation between pixels, may have a hyperbolic relationship as expressed in Equation (24) below:

$$\Delta V_{TH} \approx a\frac{1}{t-t_0}+b. \tag{24}$$

Considering the relationship between the sampling time $t_s$ and the optimal offset voltage formation time $t_0$, the following Equation (25) may be obtained. It may be possible to decrease the optimal offset voltage formation time $t_0$ by decreasing the sampling time $t_s$. Accordingly, according to example embodiments of the present disclosure, the offset voltage formation period to may be set to be longer than the sampling time $t_s$, and for example, may be set to be two to six times of the sampling time $t_s$. In this case, the sampling time $t_s$ may be set to be equal to or less than 1.5 horizontal periods.

$$\int_0^{Vi}\frac{dV}{g(V)} = \frac{I_0}{C}t_s \equiv fg,\ fg = 0.1\sim 2 \tag{25}$$

$$g'(0) \approx \frac{\ln 10}{S}$$

$$t_0 = \frac{(1+\beta g(Vi))}{(\alpha+\eta-\alpha\eta)}\frac{S}{\ln 10}fgt_s$$

where S is an S-factor (a sub-threshold slope) of the driving transistor.

Accordingly, when the offset voltage formation period $t_0$ is set considering the sampling time $t_s$, the current $I(V_{gs})$ of the driving transistor may be expressed as the following Equation (26). In this case, a variation in current caused by the variation in threshold voltage may be primarily cancelled.

$$I(V_{gs}) = I_0 g\left(\alpha(V_{data}-V_{ref})-\frac{S}{\ln 10}+o(\Delta V)^2\right). \tag{26}$$

As a result, the light emitting display apparatus according to an example embodiment of the present disclosure may form the data offset voltage Voffset at the gate electrode (e.g., the first pixel node) of the driving transistor through the offset voltage formation period of each pixel between the sampling period and the data writing period. Accordingly, it is possible to compensate for a sampling voltage variation between pixels as well as a threshold voltage variation between driving transistors provided in the pixels, and thus to decrease the voltage variation between the pixels caused by the threshold voltage variation between the driving transistors provided in the pixels, allowing for improved image quality.

Figure 7:
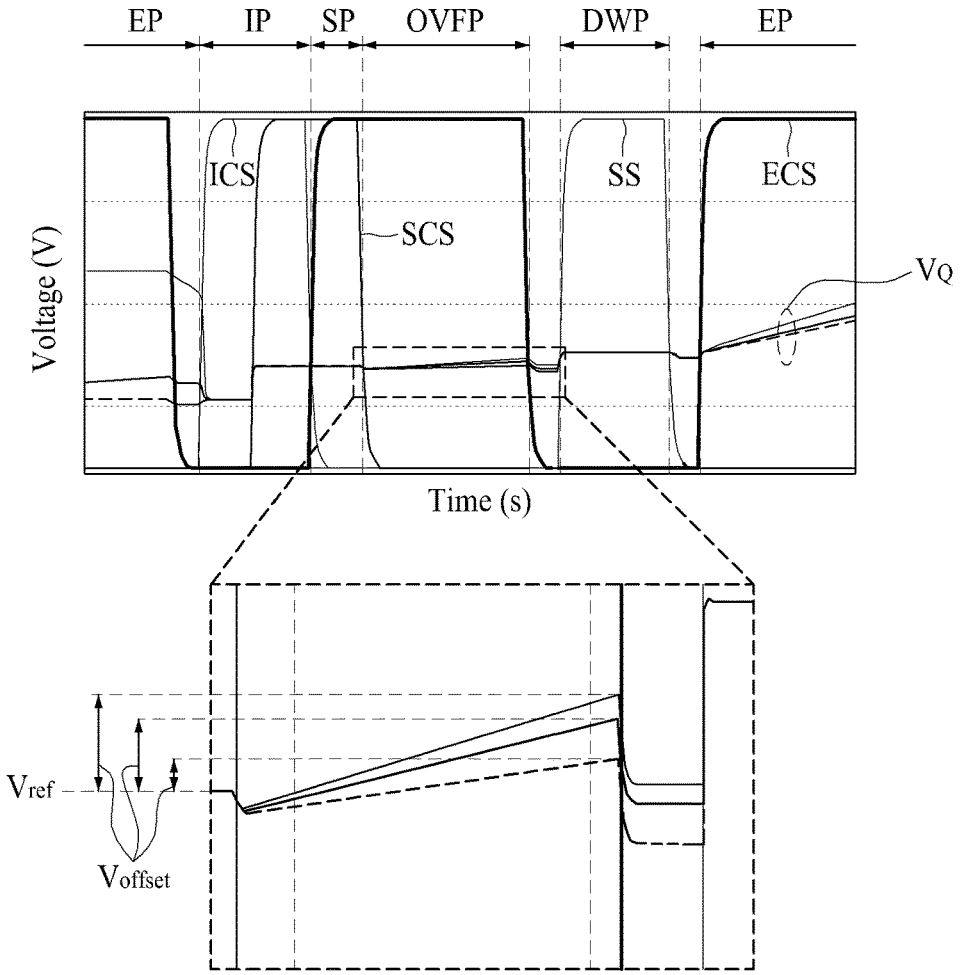
FIG. 7 is a waveform diagram showing a result of simulating operation of three pixels that are arranged in the same horizontal line and that include driving transistors having different threshold voltages, in the light emitting display apparatus according to an example embodiment of the present disclosure.

FIG. 7 is a waveform diagram showing a result of simulating operation of three pixels that are arranged in the same horizontal line and that include driving transistors having different threshold voltages, in the light emitting display apparatus according to an example embodiment of the present disclosure shown in FIGS. 2 and 3.

As can be seen from FIG. 7, when the driving transistors of the pixels have different threshold voltages, the data offset voltages Voffset having different magnitudes may be formed at the first pixel node connected to the gate electrode of the driving transistor during the offset voltage formation period OVFP. Accordingly, it may be possible to compensate for the variation of voltage between the pixels as well as the threshold voltage variation between the driving transistors provided in the pixels by the data offset voltage Voffset formed at the first pixel node during the offset voltage formation period OVFP.

According to the present disclosure, the light emitting display apparatus and the driving method thereof are not limited to the pixel structure shown in FIGS. 2 to 4. The pixels may be applied to any light emitting display apparatus operating in the order of the initialization period, the sampling period (or the internal compensation period), the data writing period, and the light emission period and a driving method thereof. In this case, it may be possible to have the same effect by the offset voltage formation period with a longer time than the sampling period being inserted between the sampling period and the data writing period.

With the light emitting display apparatus and the driving method thereof according to an example embodiment of the present disclosure, it may be possible to compensate for a sampling voltage variation between pixels as well as a threshold voltage variation between driving transistors provided in the pixels, and thus to decrease the sampling voltage variation between the pixels caused by the threshold voltage variation between the driving transistors provided in the pixels, allowing for improved image quality.

The present disclosure is not limited to the aforementioned example embodiments and the accompanying drawings, and it will be apparent to those skilled in the art that various substitutions, modifications, and changes can be made without departing from the spirit of the present disclosure. Therefore, the scope of the present disclosure may be defined by the appended claims, and all changes or modifications derived from the meaning and scope of the claims and their equivalents should be construed as being included within the scope of the present disclosure.

What is claimed is:

1. A light emitting display apparatus, comprising:

a light emitting display panel including a plurality of pixels each operating in order of an initialization period, a sampling period, an offset voltage formation period, a data writing period, and a light emission period;

a data driving circuit configured to supply data voltage to each of the pixels;

a gate driving circuit configured to provide, to each of the pixels, a control signal having voltage levels determined for the initialization period, the sampling period, the offset voltage formation period, the data writing period, and the light emission period of a corresponding pixel; and a timing controller configured to control the data driving circuit and the gate driving circuit, wherein the offset voltage formation period is two to six times of the sampling period.

2. The light emitting display apparatus of claim 1, wherein the sampling period is equal to or less than 1.5 horizontal periods.

3. The light emitting display apparatus of claim 1, wherein:

each of the pixels comprises a light emitting device and a pixel circuit connected to the light emitting device; and each pixel circuit comprises:

a driving transistor having a gate electrode connected to a first pixel node, a source electrode connected to a second pixel node, and a drain electrode connected to a third pixel node;

a switching circuit configured to supply a reference voltage or the data voltage to the first pixel node;

an initialization transistor configured to supply an initialization voltage to the second pixel node;

an emission control transistor configured to supply a pixel driving voltage to the third pixel node, the emission control transistor being turned off during the initialization period and the data writing period and being turned on during the sampling period, the offset voltage formation period, and the light emission period; and a storage capacitor connected between the first pixel node and the second pixel node.

4. The light emitting display apparatus of claim 3, wherein, in the offset voltage formation period, a voltage of the first pixel node is changed by being coupled to a change in voltage of the second pixel node corresponding to a current flowing through the driving transistor.

5. The light emitting display apparatus of claim 3, wherein the switching circuit comprises:

a first switching transistor configured to supply the data voltage to the first pixel node; and a second switching transistor configured to supply the reference voltage to the first pixel node.

6. The light emitting display apparatus of claim 5, wherein:

the first switching transistor is turned on during only the data writing period;

the second switching transistor is turned on during only the initialization period and the sampling period; and the initialization transistor is turned on during only the initialization period.

7. The light emitting display apparatus of claim 5, wherein the gate driving circuit is configured to provide, to the corresponding pixel:

a scan control signal for switching of the first switching transistor;

a sampling control signal for switching of the second switching transistor;

an initialization control signal for switching of the initialization transistor; and an emission control signal for switching of the emission control transistor.

8. The light emitting display apparatus of claim 3, wherein:

the switching circuit comprises a switching transistor turned on during the initialization period and the sampling period to supply the reference voltage to the first pixel node, and turned on during the data writing period to supply the data voltage to the first pixel node; and the initialization transistor is turned on during only the initialization period.

9. The light emitting display apparatus of claim 8, wherein the gate driving circuit provides, to the corresponding pixel:

a scan control signal for switching of the switching transistor;

an initialization control signal for switching of the initialization transistor; and an emission control signal for switching of the emission control transistor.

10. The light emitting display apparatus of claim 3, wherein the second pixel node is electrically floated when the initialization transistor is turned off.

11. The light emitting display apparatus of claim 3, wherein in the offset voltage formation period, a data offset voltage corresponding to a current flowing through the driving transistor is formed at the first pixel node by the pixel driving voltage supplied from a pixel driving voltage line to the third pixel node and a sampling voltage stored in the storage capacitor in response to an emission control signal of a gate-on voltage level.

12. A method of driving a light emitting display apparatus including a plurality of pixels each having a light emitting device and a pixel circuit connected to the light emitting device, the method comprising:

operating each of the pixels in order of an initialization period, a sampling period, an offset voltage formation period, a data writing period, and a light emission period, wherein the offset voltage formation period is two to six times of the sampling period.

13. The method of claim 12, wherein the sampling period is equal to or less than 1.5 horizontal periods.

14. The method of claim 12, wherein:

the pixel circuit of each of the pixels comprises:

a driving transistor having a gate electrode connected to a first pixel node, a source electrode connected to a second pixel node, and a drain electrode connected to a third pixel node; and a storage capacitor connected between the first pixel node and the second pixel node;

the sampling period comprises electrically floating the second pixel node, supplying a reference voltage to the first pixel node, and supplying a pixel driving voltage to the third pixel node;

the offset voltage formation period comprises electrically floating each of the first and second pixel nodes, and supplying the pixel driving voltage to the third pixel node; and the data writing period comprises electrically floating each of the second and third pixel nodes, and supplying a data voltage to the first pixel node.

15. The method of claim 14, wherein:

the initialization period comprises:

electrically floating the third pixel node;

supplying the reference voltage to the first pixel node; and supplying an initialization voltage to the second pixel node; and the light emission period comprises:

blocking the data voltage and the reference voltage supplied to the first pixel node;

blocking the initialization voltage supplied to the second pixel node; and supplying the pixel driving voltage to the third pixel node.

16. The method of claim 15, wherein, in the offset voltage formation period, a voltage of the first pixel node is changed by being coupled to a change in voltage of the second pixel node corresponding to a current flowing through the driving transistor.

17. The method of claim 15, wherein the reference voltage is supplied to the first pixel node through a data line connected to the pixel circuit.

18. The method of claim 14, wherein, in the offset voltage formation period, a data offset voltage corresponding to a current flowing through the driving transistor is formed at the first pixel node by the pixel driving voltage supplied from a pixel driving voltage line to the third pixel node and a sampling voltage stored in the storage capacitor in response to an emission control signal of a gate-on voltage level.

* * * * *